US010061240B2

(12) United States Patent
Kim et al.

(10) Patent No.: US 10,061,240 B2
(45) Date of Patent: Aug. 28, 2018

(54) FUSING UNIT AND IMAGE FORMING APPARATUS HAVING THE SAME

(71) Applicant: S-Printing Solution Co., Ltd., Suwon-si (KR)

(72) Inventors: Dong-kyun Kim, Swuon-si (KR); Seong-yul Kim, Yongin-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/646,477

(22) Filed: Jul. 11, 2017

(65) Prior Publication Data

US 2018/0196381 A1 Jul. 12, 2018

(30) Foreign Application Priority Data

Jan. 11, 2017 (KR) ..... 10-2017-0004277

(51) Int. Cl.
*G03G 15/20* (2006.01)

(52) U.S. Cl.
CPC ..... *G03G 15/2053* (2013.01); *G03G 15/2025* (2013.01)

(58) Field of Classification Search
USPC ..... 399/107, 110, 122, 320, 328, 329
See application file for complete search history.

(56) References Cited

U.S. PATENT DOCUMENTS

| | | | | |
|---|---|---|---|---|
| 8,712,302 | B2 * | 4/2014 | Nakamura | G03G 15/206 399/122 |
| 8,824,927 | B2 * | 9/2014 | Watanabe | G03G 15/2032 399/122 |
| 8,831,495 | B2 | 9/2014 | Kim et al. | |
| 8,843,013 | B2 * | 9/2014 | Sawamura | G03G 15/2053 399/122 |
| 8,906,496 | B2 | 12/2014 | Maniwa | |
| 9,709,930 | B2 * | 7/2017 | Sahara | G03G 15/2017 |

FOREIGN PATENT DOCUMENTS

| | | |
|---|---|---|
| JP | 2005-107013 | 4/2005 |
| JP | 3865035 | 10/2006 |
| JP | 2009-134074 | 6/2009 |
| JP | 2011-221270 | 11/2011 |
| KR | 10-2012-0071021 | 7/2012 |
| KR | 10-01644210 | 7/2016 |

* cited by examiner

*Primary Examiner* — Hoan Tran
(74) *Attorney, Agent, or Firm* — Staas & Halsey LLP

(57) ABSTRACT

A fusing unit and an image forming apparatus includes a housing, a fusing belt disposed inside the housing and a pressing roller forming a nip with the fusing belt, and a receiving portion disposed to face the fusing belt at a position spaced downwardly apart from the fusing belt in a gravity direction.

20 Claims, 13 Drawing Sheets

FUSING UNIT AND IMAGE FORMING APPARATUS HAVING THE SAME

CROSS-REFERENCE TO RELATED APPLICATIONS

This application claims priority from Korean Patent Application No. 10-2017-0004277, filed on Jan. 11, 2017 in the Korean Intellectual Property Office, the disclosure of which is incorporated herein by reference in its entirety.

BACKGROUND

1. Field

Units and apparatuses consistent with what is disclosed herein relate to a fusing unit and an image forming apparatus including the same, and more particularly, to a fusing unit capable of receiving a lubricant leaking from a fusing belt and an image forming apparatus including the fusing unit.

2. Description of the Related Art

Generally, in a printing operation of an image forming apparatus, the paper with the toner developed thereon is heated and pressed as the paper is passed through the fusing unit so that the toner is fixed onto the paper. Specifically, the toner developed on the paper is fixed onto the paper by a fusing roller or a fusing belt which forms a nip in contact with the pressing roller.

For such fusing unit, a fusing unit using a fixing belt, which is capable of printing at a relatively higher speed and requires less energy consumption than the fusing unit using a fixing roller, is widely used.

The fusing unit using the fusing belt has no rotating axis, and the fusing belt is rotated by the rotation of the pressing roller with the pressing roller and the fusing belt being in contact with each other.

Disposed inside the fusing belt is a pressing member which is capable of pressing the fusing belt against the pressing roller so that the pressing roller and the fusing belt come into contact with each other to form a nip. Then, the fusing belt rotates along the surface of the pressing member, and a frictional resistance is generated at this time.

A lubricant is applied between the pressing member and the fusing belt to reduce such frictional resistance and to prevent abrasion of the respective parts due to the frictional resistance and also to prevent lowering of the rotational torque of the fusing belt.

The lubricant leaks through both sides of the fusing belt due to the reduced viscosity and pressing at high temperatures. Such leaked lubricant can flow into other parts along the internal structure of the image forming apparatus. As a result, there is a problem that other parts or units have malfunction due to the lubricant.

Further, when the paper with the toner developed thereon is placed below the fusing unit in the gravity direction, there is a problem that the lubricant leaking out of the fusing unit may fall onto the paper and contaminate the toner, make the toner smeared, and the like, thus resulting in deteriorated output quality.

SUMMARY

Exemplary embodiments of the present inventive concept overcome the above disadvantages and other disadvantages not described above. Also, the present inventive concept is not required to overcome the disadvantages described above, and an exemplary embodiment of the present inventive concept may not overcome any of the problems described above.

It is an object of the present disclosure to provide a fusing apparatus capable of receiving a lubricant leaking out of a fusing belt and an image forming apparatus including the fusing apparatus.

In order to accomplish the above object, the present disclosure provides a fusing apparatus including a housing, a fusing belt disposed inside the housing and a pressing roller forming a nip with the fusing belt, and a receiving portion disposed to face the fusing belt at a position spaced downwardly apart from the fusing belt in a gravity direction.

The receiving portion may be disposed at a position corresponding to both ends of the fusing belt.

The receiving portion may include an impregnation member.

The fusing apparatus may further include a mounting groove formed on a surface of the housing, and the impregnation member may be mounted in the mounting groove.

the impregnation member may include a fabric material.

The fabric may be a felt.

According to an exemplary embodiment, the fusing apparatus may further include a support frame configured to support the fusing belt, a guide bushing disposed between the fusing belt and the support frame, in which a first side of the guide bushing is configured to contact the fusing belt and a second side of the guide bushing is configured to contact the support frame, and a bucket extending below the support frame in the gravity direction to a distance apart from the fusing belt, and having a space formed at a position corresponding to the one side of the fusing belt to receive fluid.

Each of the support frame, the guide bushing, and the bucket may be provided as a pair.

An impregnation member may be disposed inside the bucket.

The impregnation member may include a fabric material.

The fabric may be a felt.

According to an exemplary embodiment, the fusing apparatus may include a guide groove formed on a surface of the support frame, in which a first end of the guide groove is opened toward at least one of the fusing belt and the guide bushing and a second end of the guide groove is connected to the bucket.

The first end of the guide groove may be wider than the second end of the guide groove.

According to an exemplary embodiment, the fusing apparatus may further include a pressing bracket disposed inside the fusing belt, and the lubricant is applied between the pressing bracket and the fusing belt.

The lubricant may include a base oil and a gelling agent.

Further, in order to achieve the above object, an image forming apparatus is provided, which may include a main body, and a fusing apparatus disposed inside the main body. The fusing apparatus may include a housing, a fusing belt disposed inside the housing and a pressing roller forming a nip with the fusing belt, and a receiving portion disposed to face the fusing belt at a position spaced downwardly apart from the fusing belt in a gravity direction.

BRIEF DESCRIPTION OF THE DRAWINGS

The above and/or other aspects of the present inventive concept will be more apparent by describing certain exemplary embodiments of the present inventive concept with reference to the accompanying drawings, in which.

DETAILED DESCRIPTION

Figure 1:
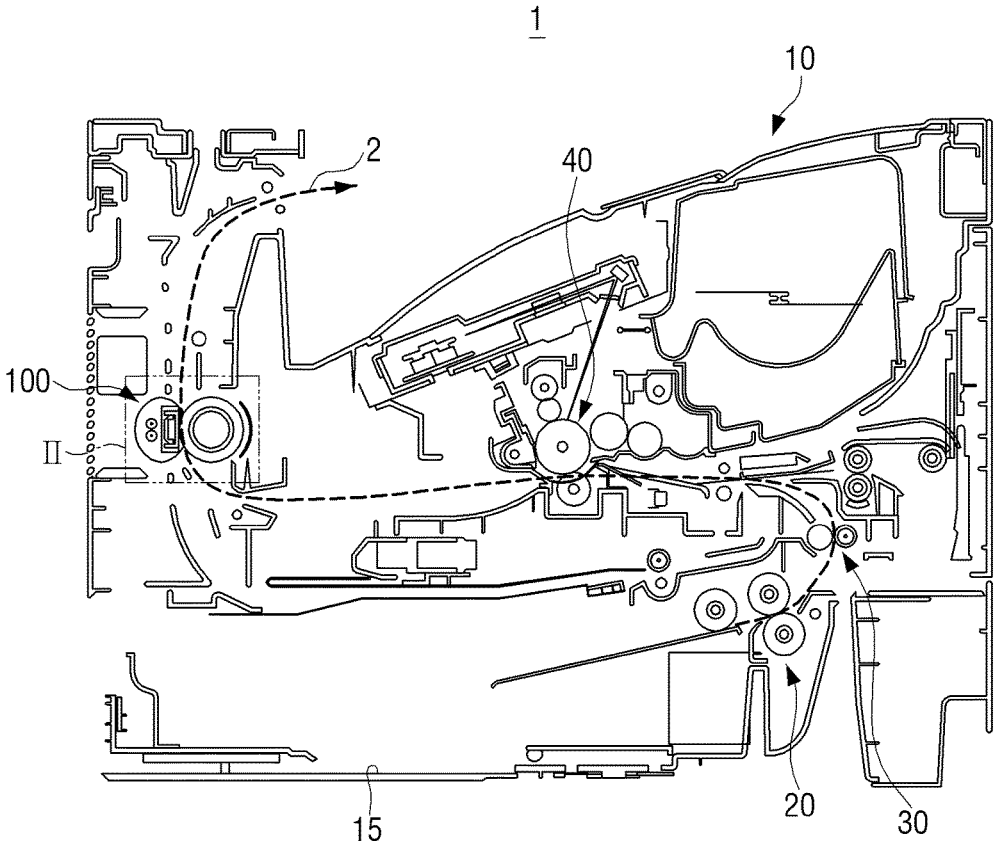
FIG. 1 is a cross-sectional view schematically showing an image forming apparatus including a fusing unit according to an exemplary embodiment.

Hereinafter, various embodiments of the present disclosure will be described in detail with reference to the accompanying drawings. However, it is not intended to limit the technologies described herein to specific embodiments, and accordingly, various modifications, equivalents, and/or alternatives of the embodiments of the techniques described herein. Regarding the drawings, like and similar reference numerals may be used for like and similar elements.

FIG. 1 is a cross-sectional view schematically showing an image forming apparatus including a fusing unit according to an exemplary embodiment. The image forming apparatus is exemplified as a laser printer 1.

However, the image forming apparatus is not limited thereto, and may be a photocopier, a scanner, a facsimile, or the like. Further, the image forming apparatus may be a multi-function peripheral (MFP) in which functions such as a copier, a scanner, a facsimile, or the like are integrated into one apparatus.

Hereinafter, for convenience of explanation, it is assumed that the image forming apparatus is the laser printer 1 as an example.

Referring to FIG. 1, the laser printer 1 includes a main body 10. The body 10 includes therein: a photosensitive medium (not shown) on which an electrostatic latent image is formed; a developing unit 40 for turning the electrostatic latent image of the photosensitive medium into a visible image; a transfer unit 50 for transferring the visible image onto a recording medium; and a fusing unit 100 for fusing the transferred image onto the recording medium.

The laser printer 1 includes therein a cassette 15 on which paper is loaded. In addition, a pick-up roller 20 for conveying a paper to a feeding roller 30 is disposed on an upper portion of the cassette.

The paper stacked in the cassette 15 is moved along a paper conveying path 2. Specifically, the paper loaded in the cassette 15 is picked up by the pick-up roller 20 and conveyed to the feeding roller 30.

In this process, the photosensitive medium charges a drum-type photosensitive member and the feeding roller 30 conveys the paper to the developing unit 40.

The developing unit 40 exposes the photosensitive member to a light controlled according to image information to thus form an electrostatic latent image on the photosensitive member. The developing unit 40 also forms a visible image, also called a toner image, by a selective adsorption of the toner onto the electrostatic latent image.

This visible image is transferred onto a recording medium, i.e., onto a paper by the transfer unit 50, and the transferred paper is conveyed to the fusing unit 100 along the paper conveying path 2.

Hereinafter, the fusing unit according to an exemplary embodiment and a receiving portion mounted in the fusing unit will be described with reference to FIGS. 2 to 5.

Figure 2:
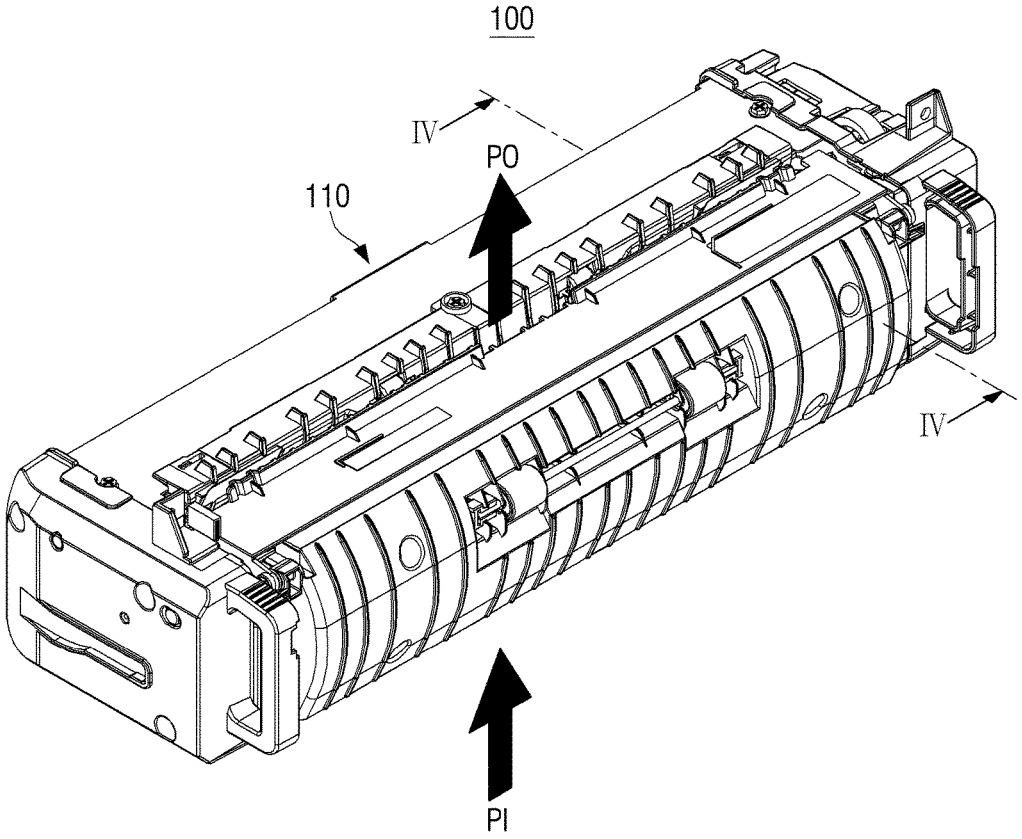
FIG. 2 is a perspective view of a fusing unit according to an exemplary embodiment.
Figure 3:
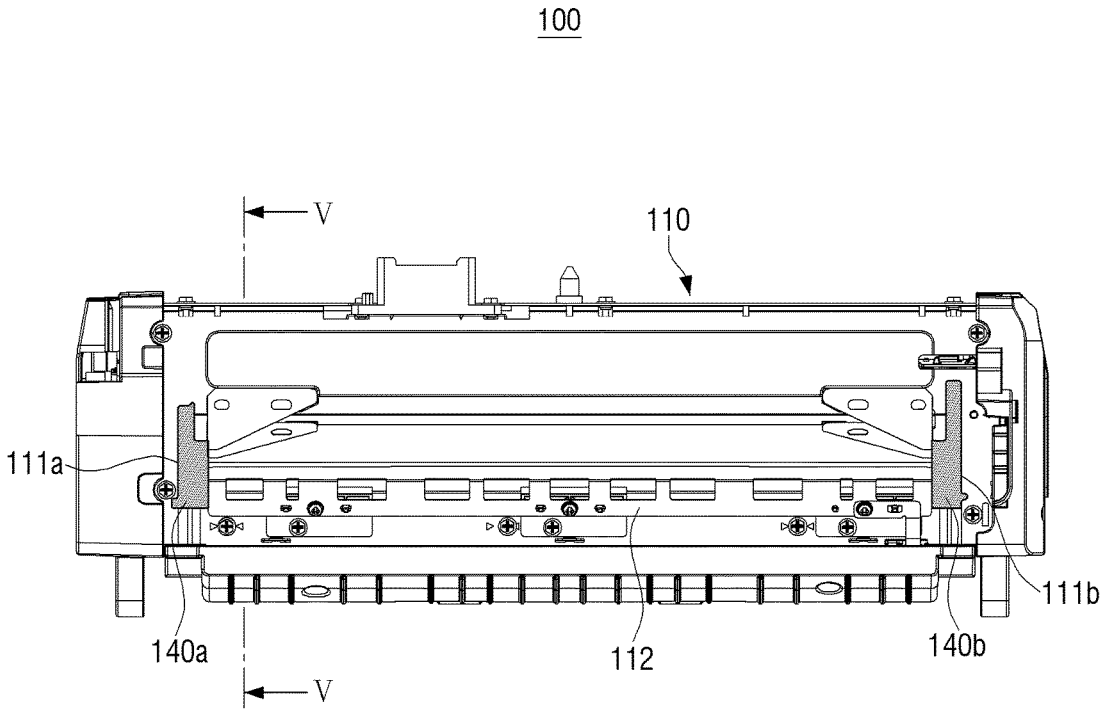
FIG. 3 is a bottom view of a fusing unit according to an exemplary embodiment.
Figure 4:
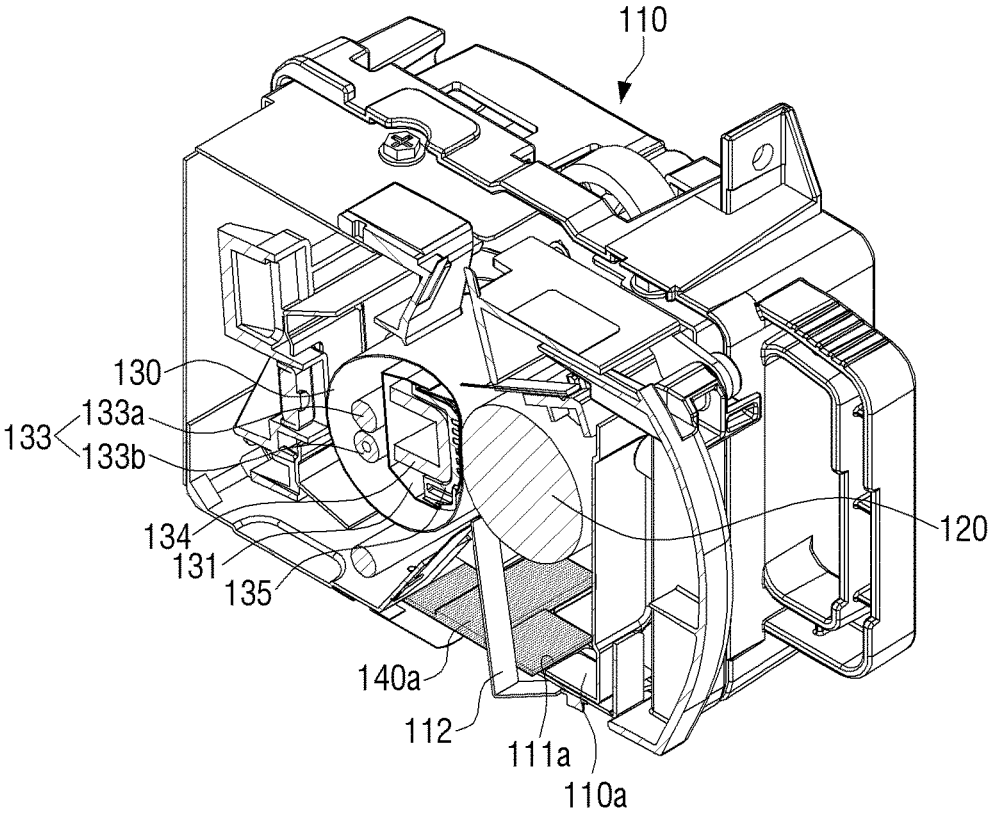
FIG. 4 is a cross-sectional perspective view cut along the line IV-IV shown in FIG. 2.
Figure 5:
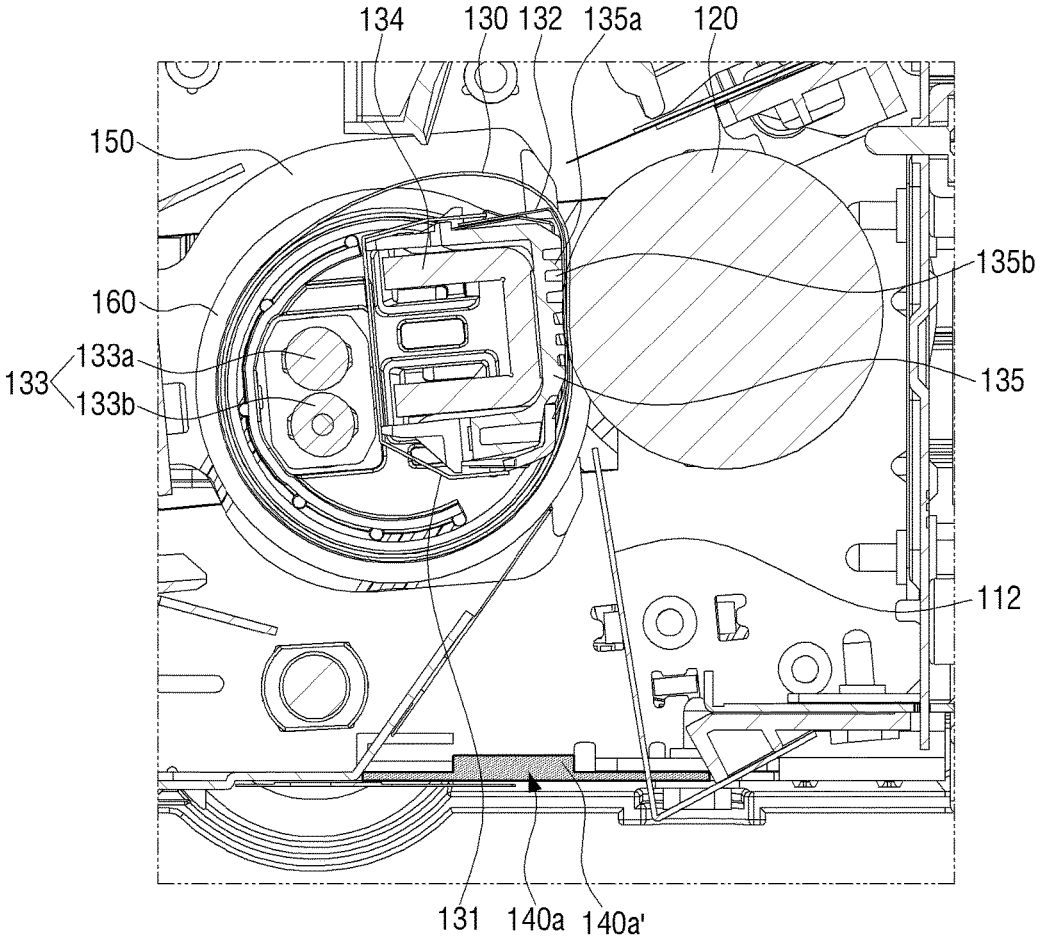
FIG. 5 is a cross-sectional view cut along the line V-V shown in FIG. 3, which is an enlarged cross-sectional view of the fusing belt.

FIG. 2 is a perspective view of a fusing unit according to an exemplary embodiment, FIG. 3 is a bottom view of a fusing unit according to an exemplary embodiment, and FIG. 4 is a cross-sectional perspective view cut along the line IV-IV shown in FIG. 2. Further, FIG. 5 is a view cut along the line V-V shown in FIG. 3, and it is an enlarged cross-sectional view of the fusing belt.

Referring to FIG. 2, the fusing unit 100 includes a housing 110 that forms an outer appearance.

The paper is fed into the fusing unit 100 along a PI direction. The paper is passed through the fusing unit 100 and is outputted in a PO direction.

When the paper is fed in the PI direction, a guide member 112 (see FIGS. 3 and 4) guides the leading edge of the paper so that the leading edge of the paper is guided toward the fusing belt 130 as close as possible. This is to prevent the occurrence of the paper conveyance failure phenomenon due to the conveyance of the paper with a poor state entering the nip.

Referring to FIGS. 4 and 5, a fusing belt 130 and a pressing roller 120 that forms a nip in contact with the fusing belt are disposed inside the housing.

The fusing belt 130 is made of synthetic resin or metal material. The synthetic resin may be a heat-resistant resin such as polyimide, polyamide or polyamide-imide, or the like and the metal may be Steel Use Stainless (SUS) and nickel.

In addition, the fusing belt 130 is generally made in a form of a film or a sleeve, and is an endless belt. Further, the fusing belt 130 is in a nearly cylindrical shape.

A center bracket 134 and a pressing bracket 135 are disposed inside the fusing belt 130.

Both ends of the center bracket 134 are connected to a support frame 150 formed at both ends of the fusing belt 130, and passed through a center of the fusing belt 130 to allow the fusing belt 130 to rotate in the housing 110. That is, the center bracket 134 serves as a skeleton of the fusing belt 130 and maintains the shape of the fusing belt 130 in a longitudinal direction of the fusing belt 130.

A heat source 133 is disposed opposite a side of the center bracket 134 that faces toward the pressing roller 120, and a first plate 131 is disposed between the center bracket 134 and the heat source 133.

The first plate 131 is formed so as to surround the center bracket 134 so that the heat source 133 and the center bracket 134, which will be described later, are not in direct contact with each other. This is to prevent the center bracket 134 from being excessively heated by the heat source 133 and to prevent the center bracket 134 from being pressed by the pressing roller 120 and damaging the heat source 133.

A guide bushing 160, which is in a nearly circular shape, is disposed between both ends of the fusing belt 130 and the support frame 150.

The guide bushing 160 eliminates the frictional resistance caused by the direct contact of the fusing belt 130 with the support frame 150 when the fusing belt 130 rotates and allows the fusing belt 130 to maintain nearly the circular shape during rotation of the fusing belt 130. Further, the guide bushing 160 regulates a transversal movement of the fusing belt 130.

Therefore, the guide bushing 160 is rotatably disposed, with the center thereof being passed through by the center bracket 134, and the guide bushing 160 prevents the fusing belt 130 and the support frame 150 from directly contacting each other.

The pressing bracket 135 is disposed on an upper side of a surface of the center bracket 134 that faces toward the pressing roller 120 and presses the fusing belt 130 toward the pressing roller 120.

A second plate 132 is disposed between the pressing bracket 135 and the fusing belt 130.

The second plate 132 prevents a direct contact between the pressing bracket 135 and the fusing belt 130 and thus prevents excessive frictional resistance from occurring between the pressing bracket 135 and the fusing belt 130 due to rotation of the fusing belt 130.

Generally, the pressing roller 120 is configured such that a heat-resistant elastic layer is stacked on a surface thereof, and then a release layer using a heat-resistant resin coat or a heat-resistant rubber coat is stacked thereon. This pressing roller 120 is disposed to press the fusing belt 130.

Accordingly, the fusing belt 130 comes into contact with the pressing roller 120 as the pressing bracket 135 located inside the fusing belt 130 and the pressing roller 120 are pressed against each other.

When the pressing roller 120 starts rotating, the fusing belt 130 is rotated by the pressure and the frictional resistance exerted by the pressing roller 120.

At this time, the contacting surfaces of the fusing belt 130 and the second plate 132 are subject to friction.

The second plate 132 is moved by a limited distance in the same direction as the rotation direction of the fusing belt 130 due to frictional resistance generated by the friction between the fusing belt 130 and the second plate 132. As a result, the contacting surfaces of the second plate 132 and the pressing bracket 135 are also subject to friction.

A plurality of ribs 135*a* are formed on a surface of the pressing bracket 135 that is in contact with the second plate 132, to reduce frictional resistance between the pressing bracket 135 and the second plate 132.

The plurality of ribs 135*a* are spaced apart from each other with a predetermined interval 135*b*.

This is to minimize frictional resistance by minimizing a contact area between the pressing bracket 135 and the second plate 132.

Further, the surface of the second plate 132 that is in contact with the fusing belt 130 and the surface of the second plate 132 that is in contact with the pressing bracket 135 are applied with a lubricant, respectively.

The lubricant minimizes the frictional resistance between the second plate 132 and the fusing belt 130 and between the second plate 132 and the pressing bracket 135.

The lubricant is distributed beyond the interval 135*b* in a longitudinal direction of the fusing belt 130 and reduces frictional resistance on all the surfaces where the pressing bracket 135 and the second plate 132 come into contact with each other.

The lubricant is generally composed of oil in liquid state and grease in semi-solid state. The main ingredient of the oil is silicon or fluorine.

The fusing belt 130 is internally provided with a heat source 133 to heat unfused toner to facilitate its fusing onto the paper.

For the heat source 133, a plurality of halogen lamps 133*a*, 133*b* are generally used.

The halogen lamps 133*a*, 133*b* generate radiative heat and heat the fusing belt 130 from inside through conduction of the radiative heat.

The heated fusing belt 130 transfers heat to the paper passing through the nip so that the unfused toner is softened with the heat. The unfused toner is fused onto the paper by press-contact between the fusing belt 130 and the pressing roller 120.

As shown in FIGS. 4 and 5, a plurality of halogen lamps 133*a*, 133*b* are disposed inside the fusing belt 130. Such halogen lamps 133*a*, 133*b* and the center bracket 134 are disposed in separate sections partitioned by the first plate 131.

Radiative heat generated from the halogen lamps 133*a*, 133*b* is transmitted to the fusing belt 130 over the air.

Thus, the halogen lamps 133*a*, 133*b* may be disposed close to the rotating axis of the fusing belt 130 or may be disposed at a center of an interior of the fusing belt 130 in order to effectively transfer the radiative heat generated by the halogen lamps 133*a*, 133*b* to the fusing belt 130.

In this case, the lubricant applied to the contacting surfaces of the fusing belt 130 and the pressing bracket 135 is disposed inside the fusing belt 130 such that the lubricant is heated by the heat source 133 supplying heat to the fusing belt every time the fusing unit performs fusing process.

At high temperature, the lubricant has low viscosity and is vaporized by high temperature or has high fluidity.

When the lubricant is oil, as the temperature inside the fusing belt 130 rises, the viscosity of the oil becomes lower and accordingly, the lubricant flows along the inner surface of the fusing belt 130.

When the lubricant is grease, oil is contained in the grease. The oil contained in the grease differs in density from the grease and is prevented from separating from the grease by a thickener or gelling agent. As the temperature inside the fusing belt 130 increases, the viscosity of the grease decreases and the oil contained in the grease is separated from the thickener or gelling agent due to the pressure exerted by the pressing bracket 135 and the pressing roller 120 against each other.

When the separation phenomenon occurs, the oil contained in the grease is separated from the grease, and flowed out of the fusing belt 130 on both ends.

The oil flowing from both ends of the fusing belt 130 may fall down from the fusing belt 130 due to gravity or flow below the fusing belt 130 along the guide bushing 160 and/or the support frame 150 formed at both ends of the fusing belt 130.

At this time, the leaking oil may be smeared on the paper, thus interfering with the formation of an image, or is transferred to other parts inside the laser printer to cause malfunction of the laser printer 1.

Accordingly, the fusing unit 100 according to an exemplary embodiment includes a receiving portion that is disposed apart from the fusing belt 130 below the fusing belt 130 in the gravity direction in order to receive the oil leaking from the inside of the fusing belt 130.

The receiving portion according to an exemplary embodiment is an impregnation member 140*a*.

There may be a plurality of impregnation members, and it is preferable that the impregnation members 140*a* and 140*b* are provided as a pair each disposed at positions corresponding to both ends of the fusing belt 130.

The impregnation member 140*a* is disposed on an inner surface 110*a* of the housing that faces the fusing belt 130 at positions corresponding to both ends of the fusing belt 130 under the fusing belt 130 in the gravity direction.

The impregnation member 140*a* may be mounted on a pair of mounting grooves 111*a*, 111*b* shown in FIGS. 3 and 4 while being spaced apart from the fusing belt 130.

When the housing 110 of the fusing unit is viewed from below, a pair of mounting grooves 111*a*, 111*b* are formed at positions corresponding to both ends of the fusing belt 130.

The pair of mounting grooves 111*a*, 111*b* may have different shapes and not necessarily be in the same shape.

In addition, the impregnation member 140*a* may be arranged at the same width as the fusing belt 130. Such an arrangement allows a wider range and a greater amount of lubricant to be absorbed.

Referring to FIG. 5, a portion 140*a*' of the impregnation member may protrude more than a thickness of the mounting groove 111*a*. That is, a portion 140*a*' of the impregnation member may be formed so as to protrude further toward the inner surface 110*a* of the housing.

The impregnation member 140*a* has a lattice structure, and a plurality of fine holes can be formed by the lattice structure. The impregnation member 140*a* may be made of a porous material.

It is preferable that the impregnation member 140*a* has a thickness of 1 mm and a weight of 50 to 600 g/m$^2$ so as to facilitate installation, even when the size of the inner surface 110*a* of the housing 110 is restricted by the internal space of the housing 110.

The impregnation member 140*a* may be made of a fabric and is preferably made of a felt.

According to an exemplary embodiment, the oil leaking from both ends of the fusing belt 130 of the fusing unit 100 falls down to the upper surface of the impregnation member 140*a* and is then absorbed into the impregnation member 140*a* by capillary phenomenon. The oil does not fall onto the paper present under the fusing unit 100 or to other components inside the laser printer.

Therefore, the fusing unit 100 according to an exemplary embodiment has an improved output quality compared with the related fusing unit.

Since the oil received in the impregnation member 140*a* can be vaporized by the radiative heat emitted from the fusing belt 130, it is possible to fundamentally prevent the oil of the impregnation member 140*a* from escaping the impregnation member 140*a* and gravitating along the respective structures inside the laser printer, contaminating other parts or paper.

Hereinafter, the fusing unit according to another exemplary embodiment and the receiving portion formed therein will be described with reference to FIGS. 6 and 7.

It is to be noted that only the difference from the fusing unit according to the exemplary embodiment described above, i.e., the configuration in which the receiving portion is formed in a support frame 150 will be described mainly described below, while a description of the other same configuration will be omitted for the sake of brevity.

Figure 6:
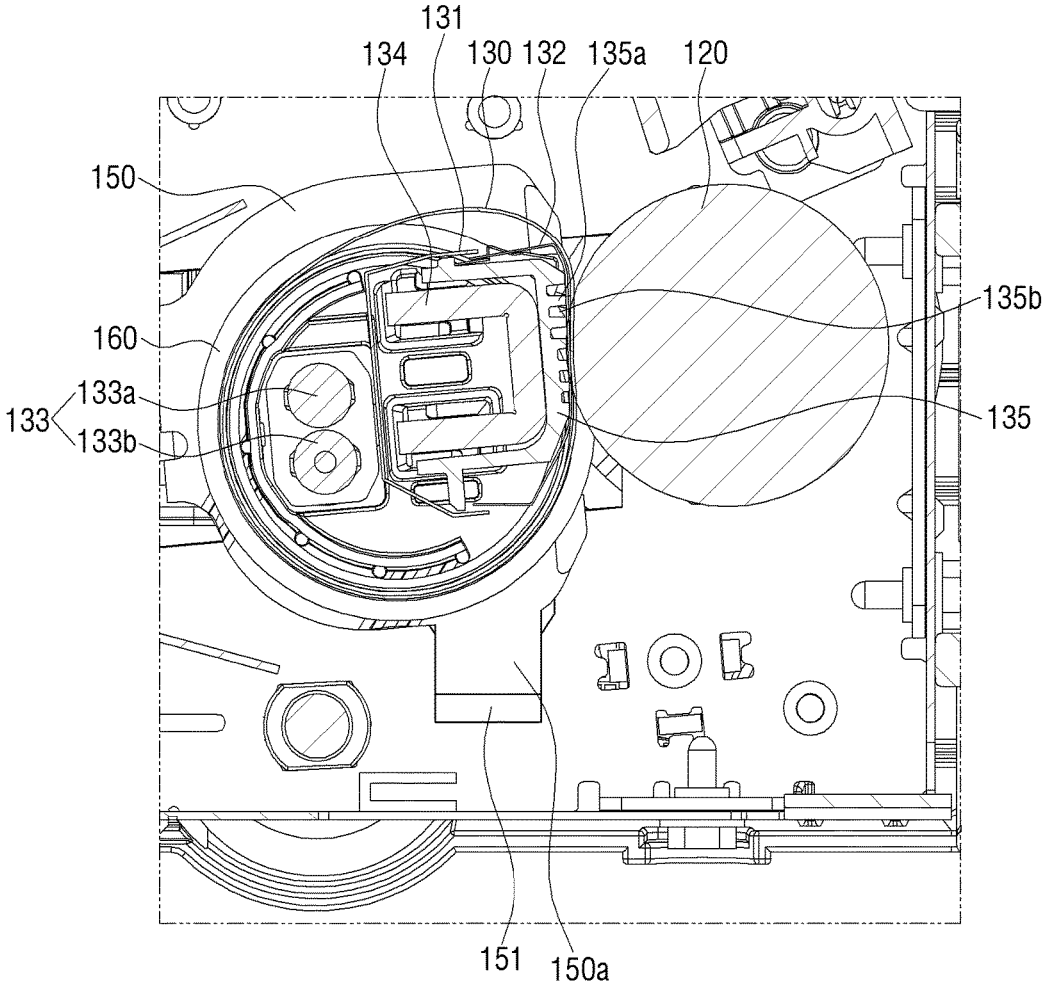
FIG. 6 is a cross-sectional view showing an example in which a receiving portion is formed in a fusing unit according to another exemplary embodiment.
Figure 7:
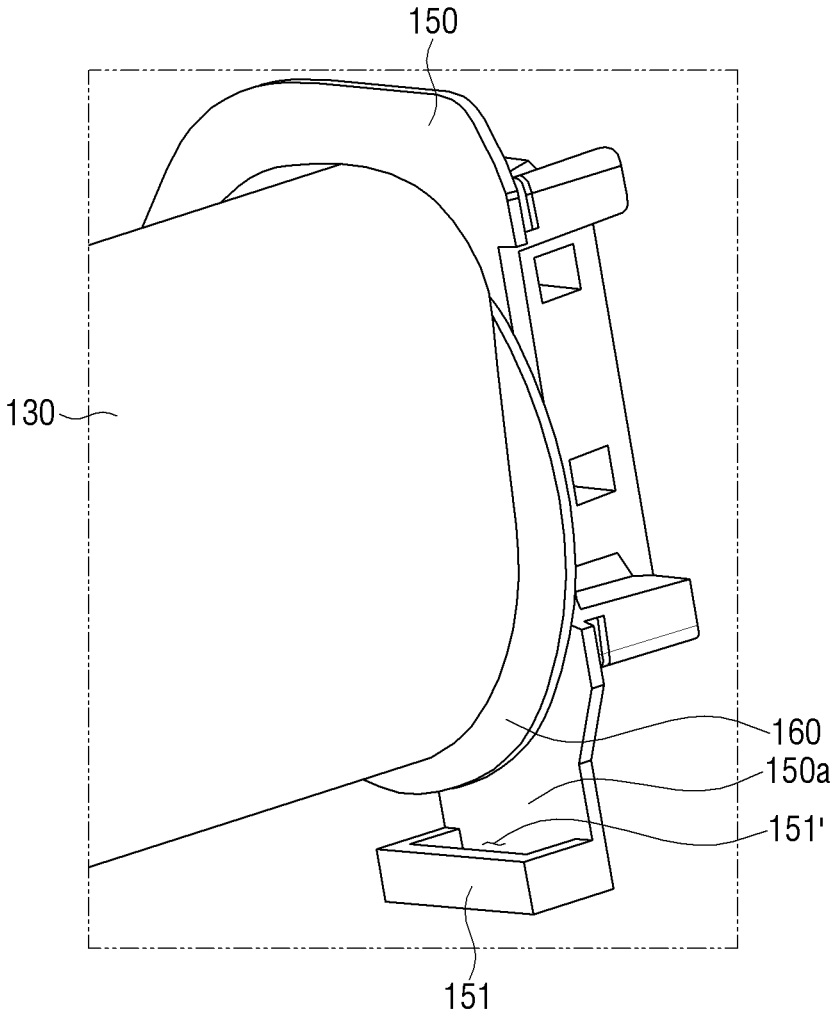
FIG. 7 is a perspective view showing the receiving portion shown in FIG. 6.

FIG. 6 is a cross-sectional view showing an example in which a receiving portion is formed in a fusing unit according to another exemplary embodiment, and FIG. 7 is a perspective view showing the receiving portion shown in FIG. 6.

Referring to FIG. 6, the receiving portion of the fusing unit according to another exemplary embodiment is formed integrally with a support frame 150. The receiving portion includes a bucket 151 that can receive fluid therein.

The bucket 151 is formed at a lower end of an extension portion 150*a* extending downward from the support frame 150.

The bucket 151 is preferably formed integrally with both the support frame 150 and the extension portion 150*a*. However, this is not to limit a possibility that the bucket 151 is formed in a removable manner from the support frame 150.

It is preferable that the buckets 151 are formed as a pair and disposed at lower ends 150*a* of the extension portions of the support frames which support both ends of the fusing belt 130, respectively.

Referring to FIG. 7, the bucket 151 may have a rectangular parallelepiped shape with an open top surface facing the fusing belt 130. However, the shape of the bucket 151 is not limited thereto, and may have various shapes such as a conical shape, a hemispherical shape, an inverted triangular shape, and so on. In other words, any shape may be used as long as the top surface of the bucket 151 is opened to receive the fluid into the interior 151' of the bucket.

The interior 151' of the bucket may be formed as a hollow space to receive the oil leaking from both ends of the fusing belt 130 therein.

The oil leaking from both ends of the fusing belt 130 flows down in the gravity direction along the guide bushing 160 and/or the support frame 150, and then naturally led into the bucket 151 formed at the lower end of the extension portion 150*a* of the support frame.

In addition, the impregnation member 140*a* may be disposed in the interior 151' of the bucket. In this case, the bucket 151 provided with the impregnation member 140*a* can receive the oil leaking from both ends of the fusing belt 130 more quickly and effectively than a bucket provided with a hollow inner space.

The bucket 151 is formed relatively closer to the fusing belt 130 than the impregnation member 140*a* according to an exemplary embodiment. Accordingly, the oil received in the interior 151' of the bucket is vaporized by the radiative heat emitted from the fusing belt 130.

Therefore, according to another exemplary embodiment, the fusing unit formed with the bucket does not have oil overflowing the bucket 151 even when there is an increased amount of oil flowing down from the fusing belt 130.

Hereinafter, the fusing unit according to yet another exemplary embodiment and the receiving portion formed therein will be described with reference to FIGS. 8 and 9.

However, only the difference from the receiving portion according to another exemplary embodiment described above, i.e., the difference of the presence of the guide groove 152 formed in the extension portion 150*a* of the support frame will be described below, and a description of the other same configuration will be omitted for the sake of brevity.

Figure 8:
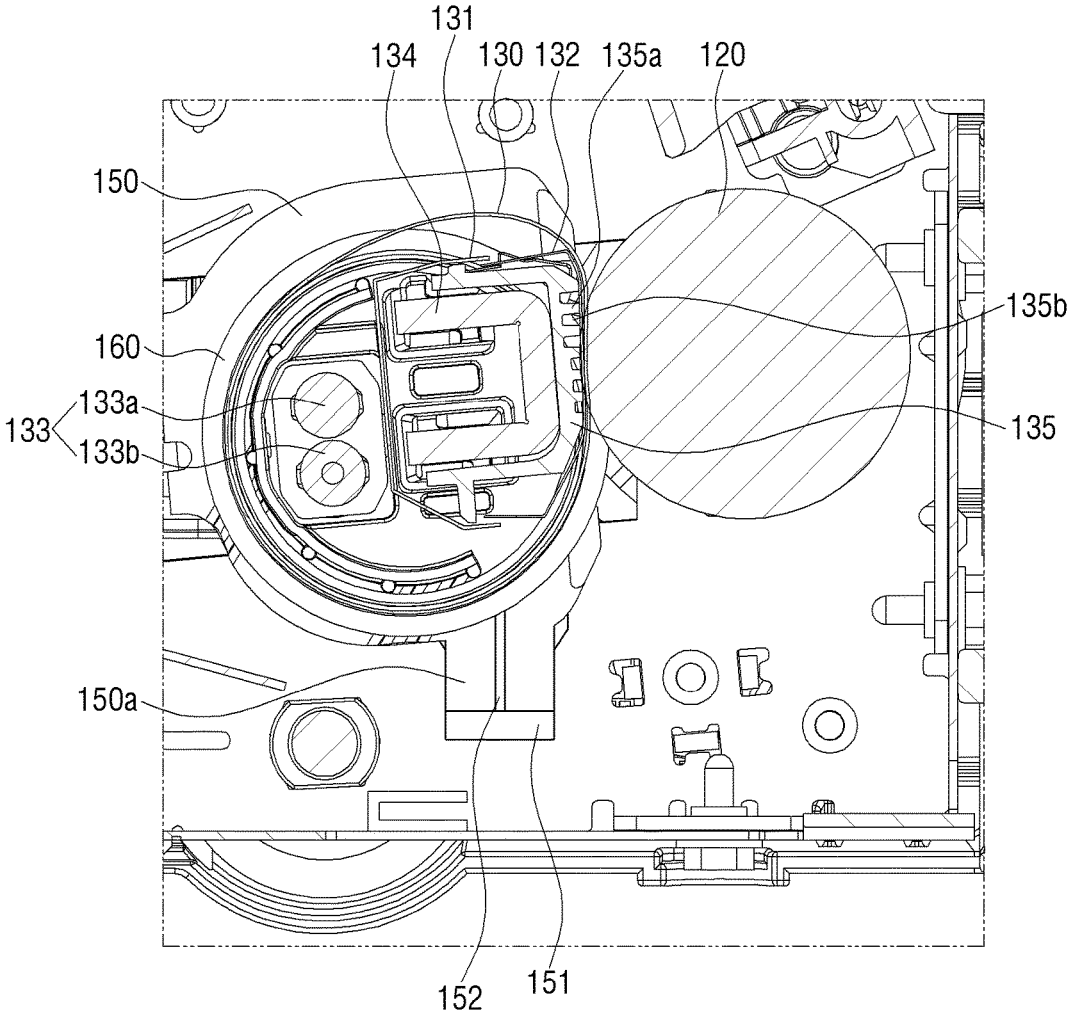
FIG. 8 is a cross-sectional view showing an example in which a receiving portion is formed in a fusing unit according to yet another exemplary embodiment.
Figure 9:
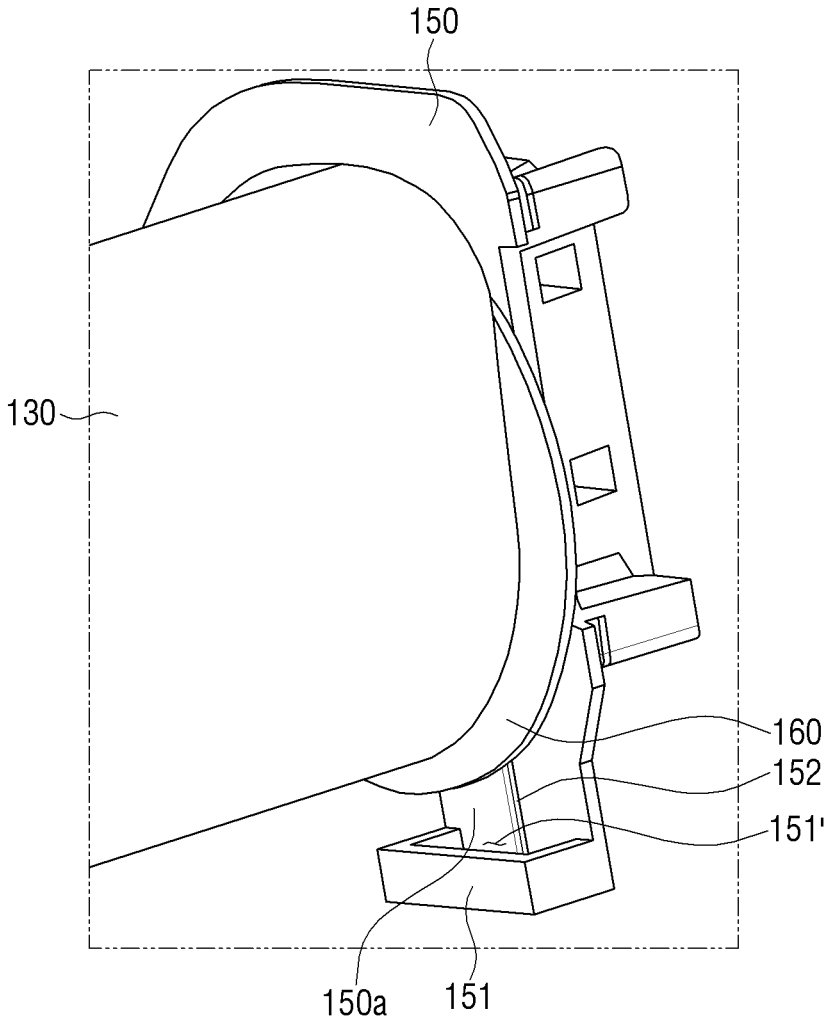
FIG. 9 is a perspective view showing the receiving portion shown in FIG. 8.

FIG. 8 is a cross-sectional view showing an example in which a receiving portion is formed in a fusing unit according to yet another exemplary embodiment, and FIG. 9 is a perspective view showing the receiving portion shown in FIG. 8.

Referring to FIG. 8, a guide groove 152 for guiding a flow of fluid is formed on a surface of the extension portion 150*a* of the support frame that faces the fusing belt 130.

Since the guide groove 152 is formed at a lower position that the fusing belt 130, the oil leaking from the fusing belt 130 can be naturally guided to flow down in the gravity direction.

In addition, it is preferable that the guide grooves 152 are formed as a pair and formed in the extension portions of the support frames on both sides, respectively.

One end of the guide groove 152 is opened toward the fusing belt 130 or the guide bushing 160 and the other end is opened toward a bottom of the interior 151' of the bucket.

The oil leaking from both ends of the fusing belt 130 does not flow down along the support frame 150, but flows down along the guide grooves 152 in the gravity direction.

Therefore, the fusing unit according to yet another exemplary embodiment can prevent the oil leaking from both ends of the fusing belt 130 from being scattered by the rotation of the guide bushing 160, and can also prevent the oil from forming droplets.

The impregnation member 140*a* may be disposed in the interior 151' of the bucket. The bucket 151 provided with the impregnation member 140*a* can receive the oil leaking from both ends of the fusing belt 130 more quickly and efficiently than a bucket with a hollow inner space.

Further, the oil received in the interior 151' of the bucket is vaporized by the radiative heat emitted from the fusing belt 130.

Hereinafter, the fusing unit according to yet another exemplary embodiment and the guide groove formed therein will be described with reference to FIGS. 10 to 13.

However, only the difference from the fusing unit according to the exemplary embodiment described above, i.e., the difference of the presence of the guide groove 170 formed in an inner wall 110*b* of the housing will be described below, and a description of the other same configuration will be omitted for the sake of brevity.

Figure 10:
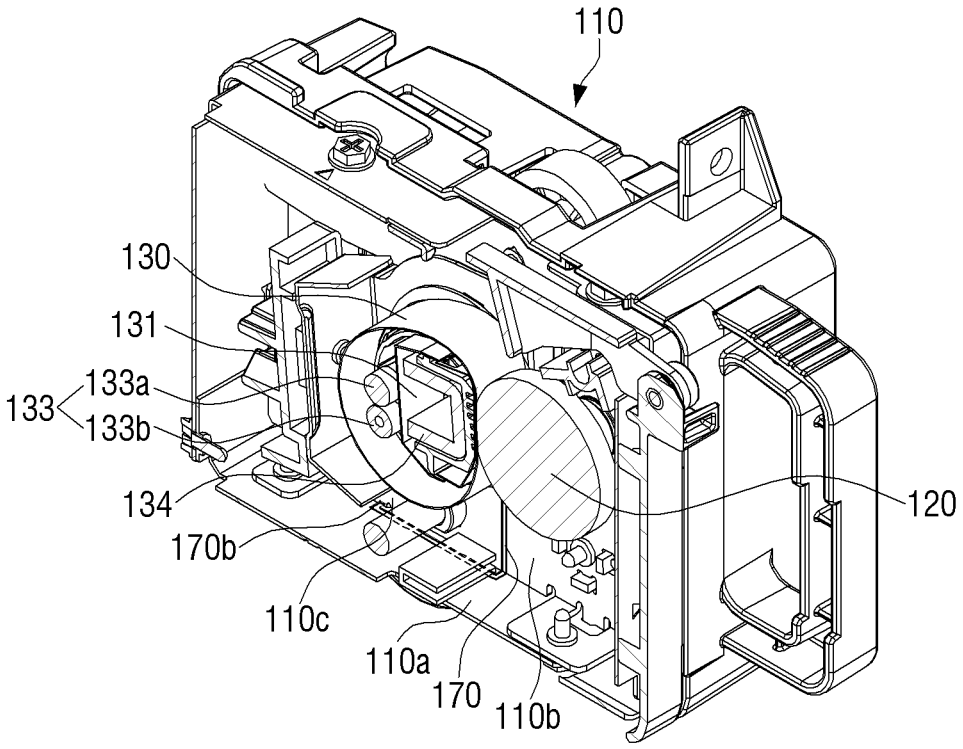
FIG. 10 is a cross-sectional perspective view showing an example in which a guide groove is formed in a fusing unit according to yet another exemplary embodiment.
Figure 11:
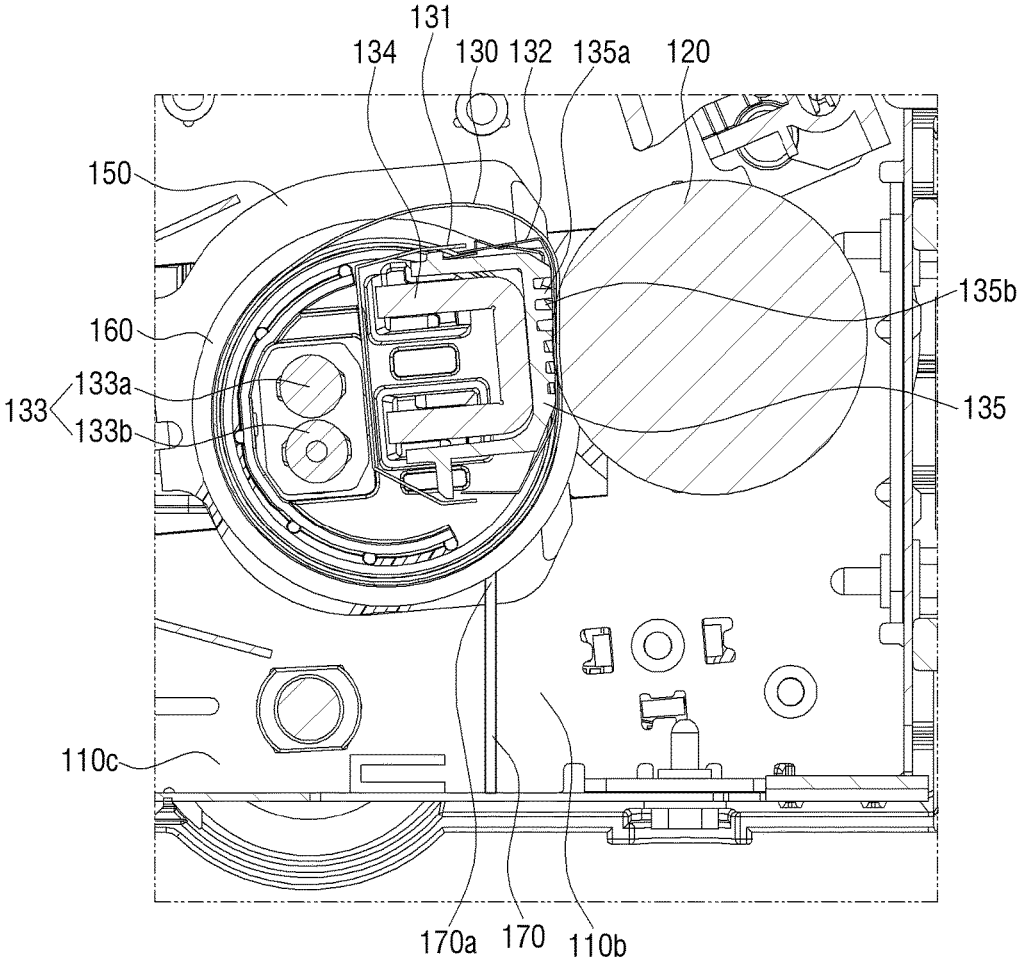
FIG. 11 is a view showing the guide groove shown in FIG. 10.
Figure 12:
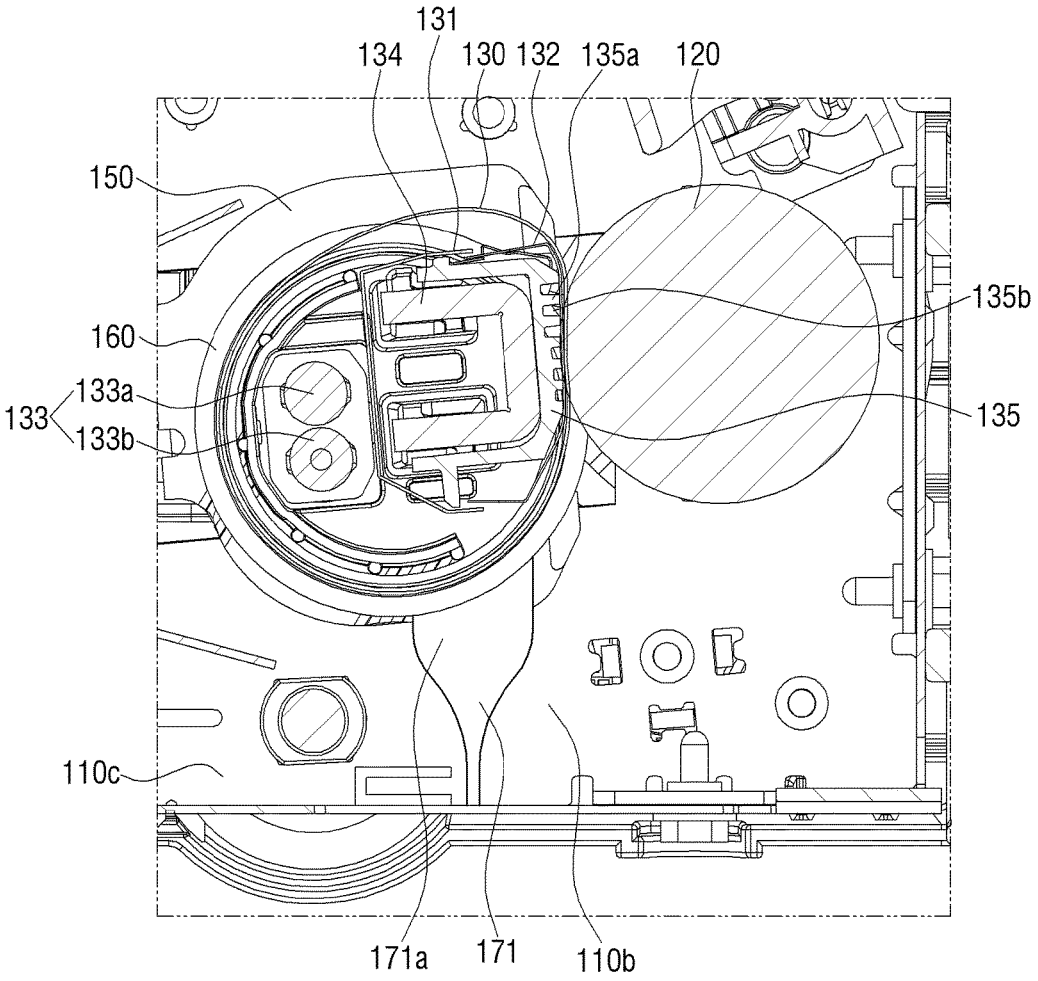
FIGS. 12 and 13 are cross-sectional views showing modified examples of the guide groove shown in FIG. 11.
Figure 13:
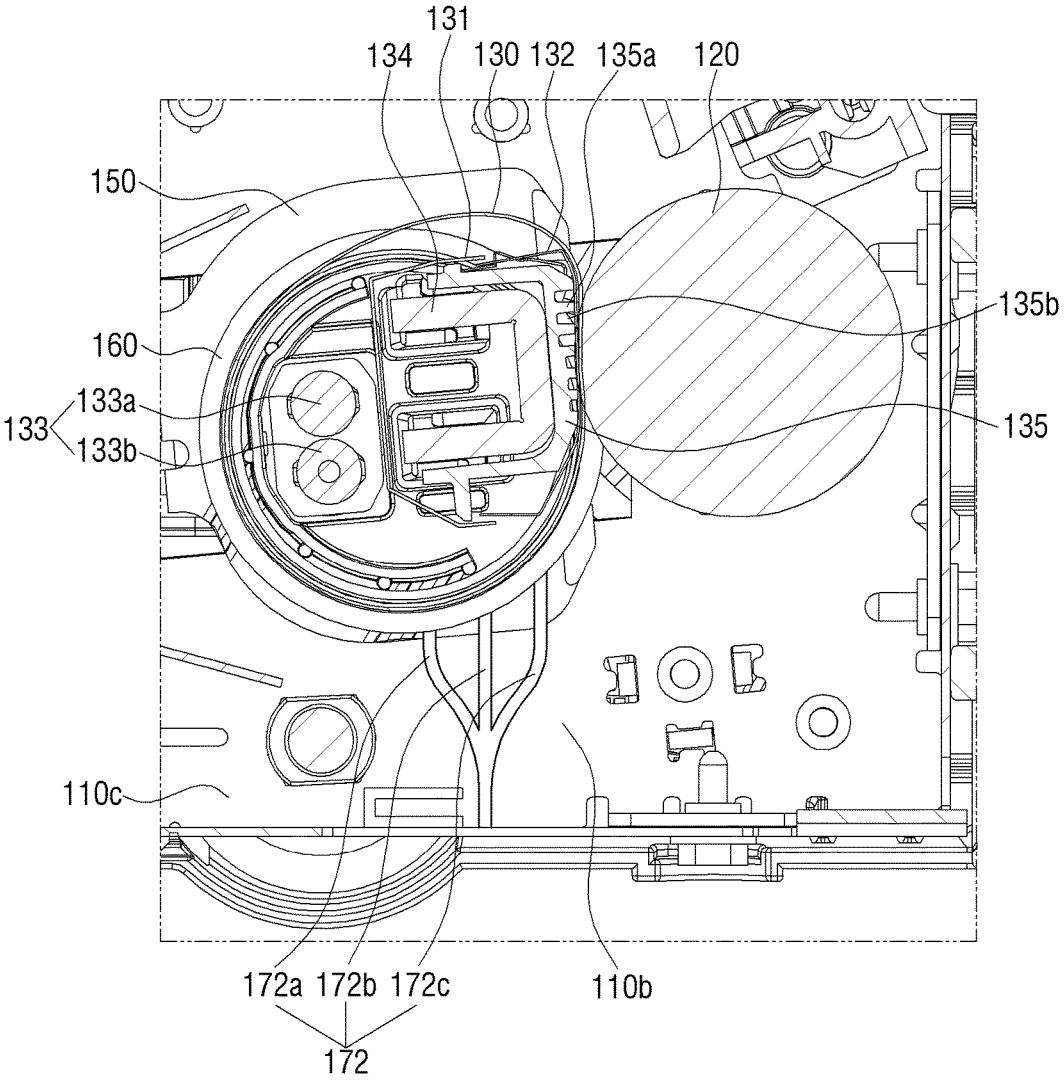

FIG. 10 is a cross-sectional perspective view showing an example in which a guide groove is formed in a fusing unit according to yet another exemplary embodiment, and FIG. 11 is a view showing the guide groove shown in FIG. 10. FIGS. 12 and 13 are cross-sectional views showing modified examples of the guide groove shown in FIG. 11.

Referring to FIG. 10, guide grooves 170 are formed in the inner surface 110*a* of the housing and inner wall 110*b* of the housing.

One end 170*a* of the guide groove is open toward the fusing belt 130 or the guide bushing 160 (see FIG. 11), and the other end 170*b* of the guide groove is passed through the other inner wall 110*c* of the housing.

The other end 170*b* of the guide groove passed through the inner wall 110*c* of the housing may be connected to a separate impregnation member (not shown) or a bucket (not shown).

Further, the other end 170*b* of the guide groove does not necessarily have to penetrate the other inner wall 110*c* of the housing.

As long as the oil flowing along the guide groove 170 can be guided into or out of the laser printer without contaminating the paper and other components in the laser printer, it is possible that the other end 170*b* of the guide groove may be formed to penetrate various portions of the inner side or the inner wall of the housing.

The guide groove 170 is preferably formed below the fusing belt 130 in the gravity direction along the inner wall 110*b* of the housing so that the oil leaking from the fusing belt 130 is naturally guided.

The oil leaking from both ends of the fusing belt 130 is concentrated at one end 170*a* of the guide groove and flow toward the other end 170*b* of the guide groove.

The guide groove 170 formed in the inner side 110*a* of the housing may be formed at a deeper depth than the guide groove 170 formed in the inner wall 110*b* of the housing. This is to prevent the oil leaking down through the guide groove 170 formed on the inner side 110*a* of the housing 110 from being concentrated at a point where the guide groove 170 formed in the inner side 110*a* of the housing meets the guide groove 170 formed in the inner wall 110*b* of the housing and overflowing the guide groove 170 formed in the side surface 110*a* of the housing.

Referring to FIGS. 12 and 13, examples of the guide grooves 171, 172 having various shapes with respect to one end of the guide groove are shown.

Referring to FIG. 12, the guide groove 171 includes a curved funnel-shaped end 171*a*. One end 171*a* of this funnel-shaped guide groove is formed in the inner wall 110*b* of the housing below the fusing belt 130 in the gravity direction.

However, the shape of one end of the guide groove 171 is not limited to the example provided above, and any shape may be used as long as the width of one end 171*a* of the guide groove is greater than the width of the other part of the guide groove 171.

Since the one end 171*a* of the guide groove has a wide width, the fusing unit according to some exemplary embodiments can prevent the oil from flowing down or scattering in various directions by the support frame 150 or the guide bushing 160 more efficiently than the fusing unit provided with the guide groove 170 according to another embodiment of the present invention.

Further, referring to FIG. 13, the guide groove 172 includes one end having a plurality of branches 172*a*, 172*b*, 172*c*.

The plurality of branches 172*a*, 172*b*, 172*c* are formed on in the inner wall 110*b* of the housing below the fusing belt 130 in the gravity direction. One end of each of the plurality of branches 172*a*, 172*b*, 172*c* is joined at a portion of the inner wall 110*b* of the housing corresponding to a middle of the height between the fusing belt 130 and the inner wall 110*a* of the housing. The other end of each of the plurality of branches 172*a*, 172*b*, 172*c* is opened toward the fusing belt 130 or the guide bushing 160.

However, the portion where the ends of the plurality of branches 172*a*, 172*b*, 172*c* are joined is not limited, and accordingly, the ends of the branches 172*a*, 172*b*, 172*c* may be joined at various heights between the fusing belt 130 and the inner side 110*a* of the housing.

According to some exemplary embodiments, the fusing unit can prevent the oil from flowing down or scattering in various directions by the support frame 150 or the guide bushing 160 more efficiently, compared to the fusing unit that has the guide groove 170 formed therein according to another embodiment of the present invention.

While the present disclosure has been particularly shown and described with reference to preferably embodiments thereof, it will be understood to those skilled in the art that various modifications and variations can be made in the present disclosure without departing from the spirit or scope of the disclosure as defined in the following claims.

What is claimed is:

1. A fusing apparatus, comprising:
a housing;
a fusing belt disposed inside the housing;
a pressing roller forming a nip with the fusing belt; and
a receiving portion disposed to face the fusing belt at a position corresponding to both ends of the fusing belt and spaced downwardly apart from the fusing belt in a gravity direction.

2. The fusing apparatus of claim 1, wherein the receiving portion includes a first receiving portion to receive lubricant that flows from a first end of the fusing belt and a second receiving portion to receive lubricant that flows from a second end of the fusing belt.

3. The fusing apparatus of claim 1, wherein the receiving portion includes an impregnation member.

4. The fusing apparatus of claim 3, wherein the impregnation member includes a fabric material.

5. The fusing apparatus of claim 4, wherein the fabric is felt.

6. A fusing apparatus, comprising:
a housing;
a fusing belt disposed inside the housing;
a pressing roller forming a nip with the fusing belt; and
a receiving portion disposed to face the fusing belt at a position spaced downwardly apart from the fusing belt in a gravity direction, the receiving portion including an impregnation member; and
a mounting groove formed on a surface of the housing, the impregnation member being mounted in the mounting groove.

7. A fusing apparatus, comprising:
a housing;
a fusing belt disposed inside the housing;
a pressing roller forming a nip with the fusing belt;
a support frame configured to support the fusing belt;
a guide bushing disposed between the fusing belt and the support frame, wherein a first side of the guide bushing is to contact the fusing belt and a second side of the guide bushing is to contact the support frame; and
a bucket disposed to face the fusing belt at a position spaced downwardly apart from the fusing belt in a gravity direction and extending below the support frame in the gravity direction to a distance apart from the fusing belt, and having a space formed at a position corresponding to an end of the fusing belt to receive fluid.

8. The fusing apparatus of claim 7, wherein each of the support frame, the guide bushing, and the bucket is provided as a pair.

9. The fusing apparatus of claim 7, wherein an impregnation member is disposed inside the bucket.

10. The fusing apparatus of claim 9, wherein the impregnation member includes a fabric material.

11. The fusing apparatus of claim 10, wherein the fabric is felt.

12. The fusing apparatus of claim 7, further comprising a guide groove formed on a surface of the support frame,
wherein a first end of the guide groove is opened toward at least one of the fusing belt and the guide bushing and a second end of the guide groove is connected to the bucket.

13. The fusing apparatus of claim 12, wherein the first end of the guide groove is wider than the second end of the guide groove.

14. A fusing apparatus, comprising:
a housing;
a fusing belt disposed inside the housing;
a pressing roller forming a nip with the fusing belt;
a receiving portion disposed to face the fusing belt at a position spaced downwardly apart from the fusing belt in a gravity direction;
a pressing bracket disposed inside the fusing belt; and
a lubricant applied between the pressing bracket and the fusing belt.

15. The fusing apparatus of claim 14, wherein the lubricant comprises a base oil and a gelling agent.

16. An image forming apparatus, comprising:
a main body; and
a fusing apparatus disposed inside the main body, the fusing apparatus including:
a housing,
a fusing belt disposed inside the housing,
a pressing roller forming a nip with the fusing belt, and
a receiving portion disposed to face the fusing belt at a position corresponding to both ends of the fusing belt and spaced downwardly apart from the fusing belt in a gravity direction.

17. The image forming apparatus of claim 16, wherein the receiving portion includes a first receiving portion to receive lubricant flowing from a first end of the fusing belt and a second receiving portion to receive lubricant flowing from a second end of the fusing belt.

18. The image forming apparatus of claim 16, wherein the receiving portion includes an impregnation member.

19. An image forming apparatus, comprising:
a main body; and
a fusing apparatus disposed inside the main body, the fusing apparatus including:
a housing,
a fusing belt disposed inside the housing,
a pressing roller forming a nip with the fusing belt,
a support frame to support the fusing belt;
a guide bushing disposed between the fusing belt and the support frame, wherein a first side of the guide bushing is to contact the fusing belt and a second side of the guide bushing is to contact the support frame, and
a bucket disposed to face the fusing belt at a position spaced downwardly apart from the fusing belt in a gravity direction and extending below the support frame in the gravity direction to a distance apart from the fusing belt, and having a space formed at a position corresponding to an of the fusing belt to receive fluid.

20. The image forming apparatus of claim 19, further comprising a guide groove formed on a surface of the support frame,
wherein a first end of the guide groove is opened toward at least one of the fusing belt and the guide bushing and a second end of the guide groove is connected to the bucket.

* * * * *